United States Patent [19]

Jalbert et al.

[11] Patent Number: 4,773,848

[45] Date of Patent: Sep. 27, 1988

[54] SEALED GAS CONTROL VALVE

[75] Inventors: Lynn A. Jalbert, West Fargo, N. Dak.; Delbert E. Carver, Onalaska, Wis.

[73] Assignee: Advanced Technology Ltd., Riverside, N. Dak.

[21] Appl. No.: 79,578

[22] Filed: Jul. 29, 1987

[51] Int. Cl.[4] ..... F23Q 9/08; F23D 5/12

[52] U.S. Cl. ..... 431/51; 431/119; 126/116 A

[58] Field of Search ..... 431/42, 23, 60, 119, 431/154, 90, 51; 157/312, 375, 384; 251/367; 126/116 A

[56] References Cited

U.S. PATENT DOCUMENTS

| | | | |
|---|---|---|---|
| 1,807,302 | 5/1931 | Braden | 431/42 |
| 1,817,051 | 8/1931 | Williams | 431/90 |
| 2,408,084 | 9/1946 | Martin | 431/119 |
| 2,954,797 | 10/1960 | Dryer | 137/312 |
| 3,027,889 | 4/1962 | Krassz | 431/90 |
| 3,126,941 | 3/1964 | Mohr et al. | 431/154 |
| 3,217,782 | 11/1965 | Vooper | 431/90 |
| 3,269,450 | 8/1966 | Licata et al. | 431/90 |
| 3,423,021 | 1/1969 | Berquist | 431/42 |
| 4,188,180 | 2/1980 | Hamelihk | 431/42 |
| 4,205,972 | 6/1980 | Vna et al. | 431/119 |
| 4,287,909 | 9/1981 | Tomper et al. | 137/312 |
| 4,543,974 | 10/1985 | Dietiher et al. | 431/60 |

*Primary Examiner*—Randall L. Green

*Attorney, Agent, or Firm*—Dorsey & Whitney

[57] ABSTRACT

A gas burning furnace is disclosed with a sealed and vented gas control valve. Sealing the gas control valve in an enclosure shields the control valve from the external environment. By venting the enclosure to the furnace pilot light, any gas leaking from the gas control valve into the enclosure is conducted to and ignited by the pilot light in a deliberate controlled manner, thereby precluding an explosion in the enclosure. Other safety features disclosed include an overheat shut-off, pilot light extinguished shut-off and blower malfunction shut-off.

6 Claims, 3 Drawing Sheets

SEALED GAS CONTROL VALVE

TECHNICAL FIELD

This invention pertains to gas burning furnaces. In particular, it pertains to a gas furnace with a vented gas control valve enclosure and additional safety features.

BACKGROUND

It is frequently necessary to place a gas burning furnace in a relatively hostile environment such as exists in livestock and poultry barns. The control mechanisms of a furnace placed in such an environment are highly susceptible to corrosion and ultimate failure. A furnace having control mechanisms impervious to the environment without compromising safety would be a decided advantage.

SUMMARY OF THE INVENTION

The present invention comprises a gas furnace with a gas control valve enclosed in a watertight enclosure. The enclosure is vented to the furnace pilot light to prevent buildup of an explosive mixture of gas and air in the enclosure. Broadly, the gas furnace hereof comprises a gas control valve, gas control valve enclosure, enclosure vent line, main burner, pilot light and blower. A high temperature limit switch shuts off the main burner if the furnace overheats. An airflow sail switch turns off gas flow to the main burner if the blower produces insufficient air pressure. A thermocouple prevents gas flow to the main burner and pilot light if the pilot light is extinguished.

The particular construction of the gas furnace and gas control valve enclosure of the present invention provides several advantages. The gas control valve is protected from the environment by its enclosure. Should the gas control valve develop a leak, the enclosure vent line harmlessly vents the leaked gas to the pilot light, thereby preventing an explosive mixture of gas and air from forming inside the enclosure. The high temperature limit switch and the airflow sail switch prevent overheating of the furnace. The thermocouple prevents gas leaks if the pilot light goes out.

DETAIL DESCRIPTION OF THE DRAWINGS

Figure 1:
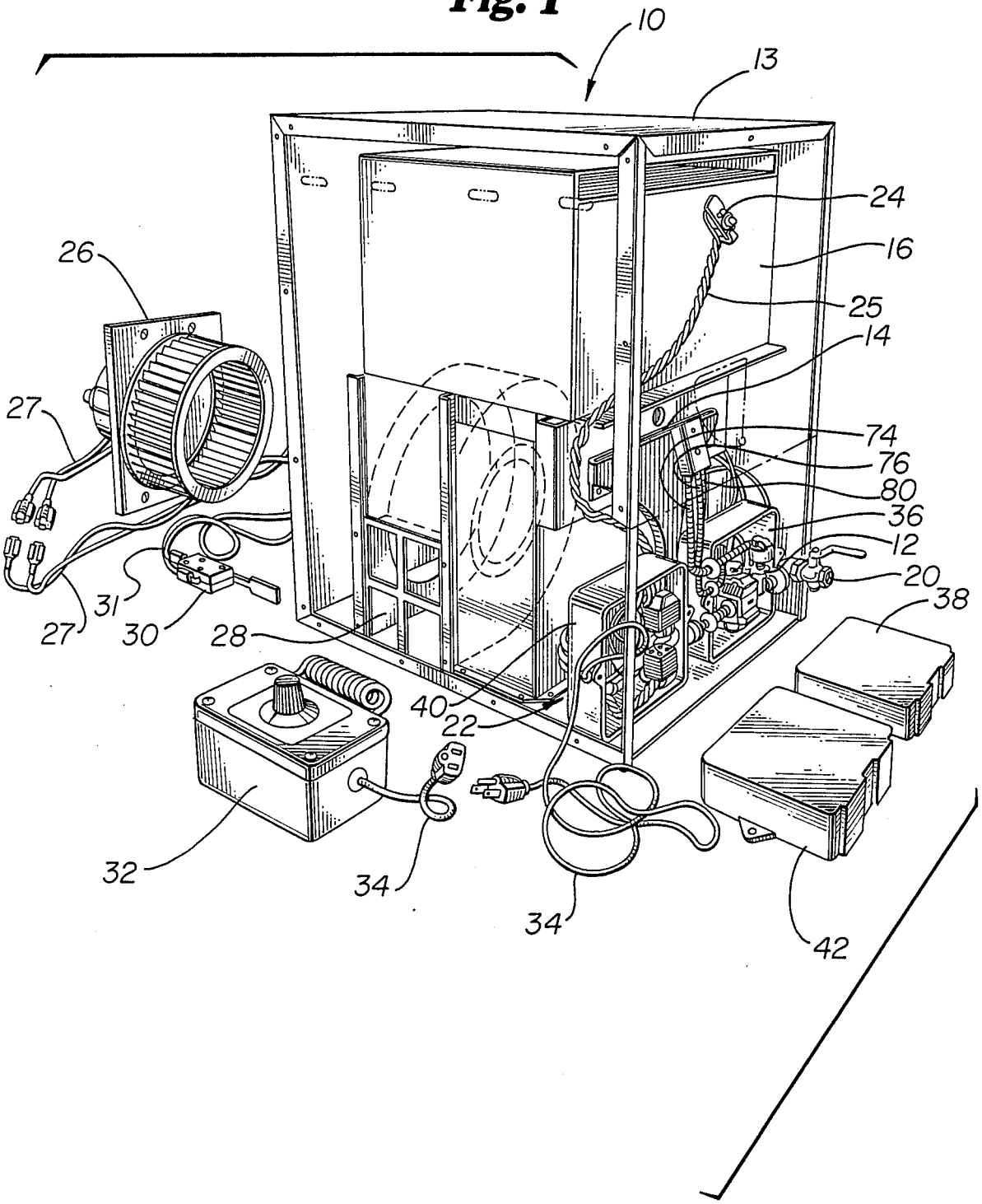
FIG. 1 is a front perspective view of the gas furnace in accordance with the present invention.
Figure 2:
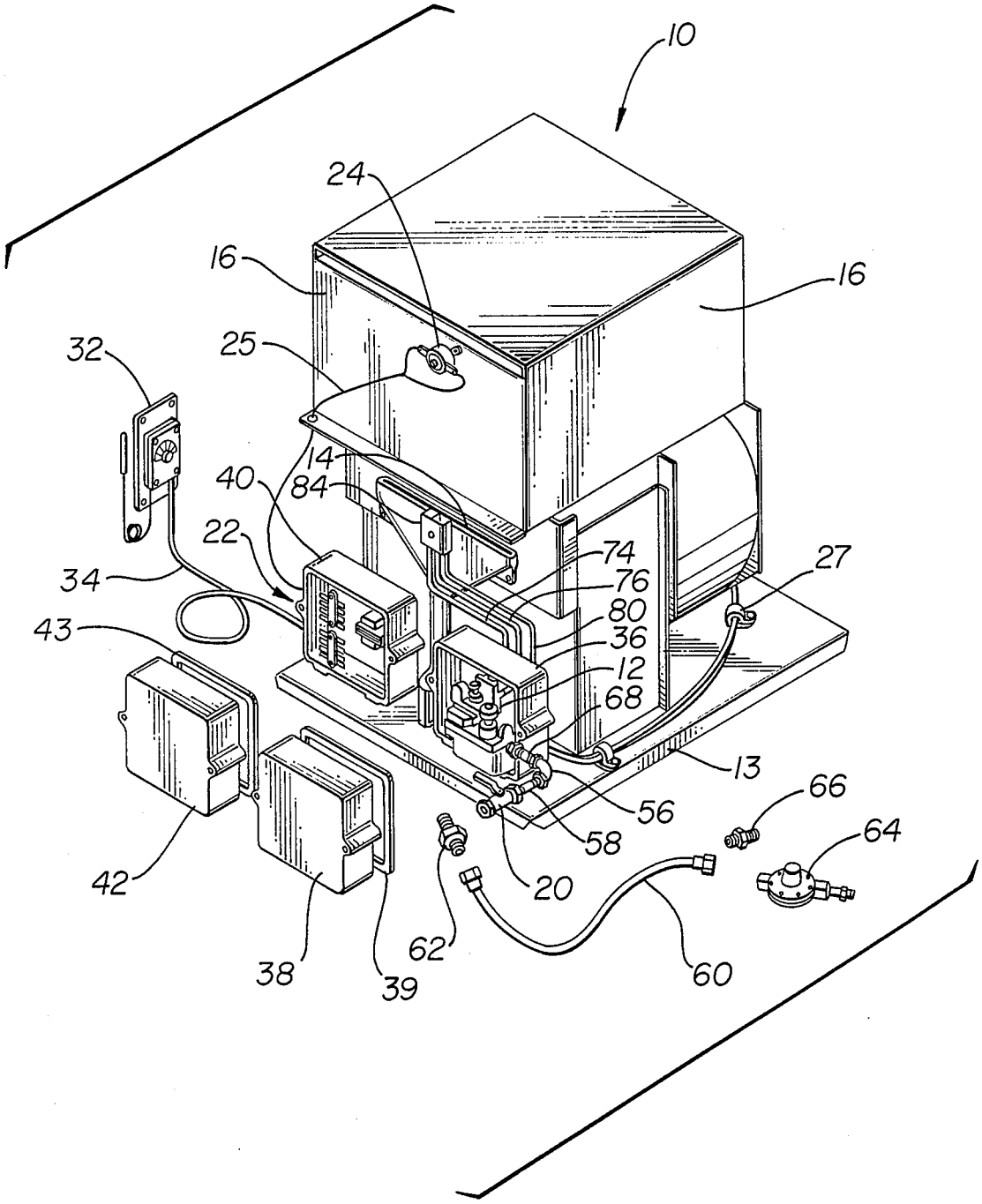
FIG. 2 is a rear perspective view of the gas furnace in accordance with the present invention.
Figure 3:
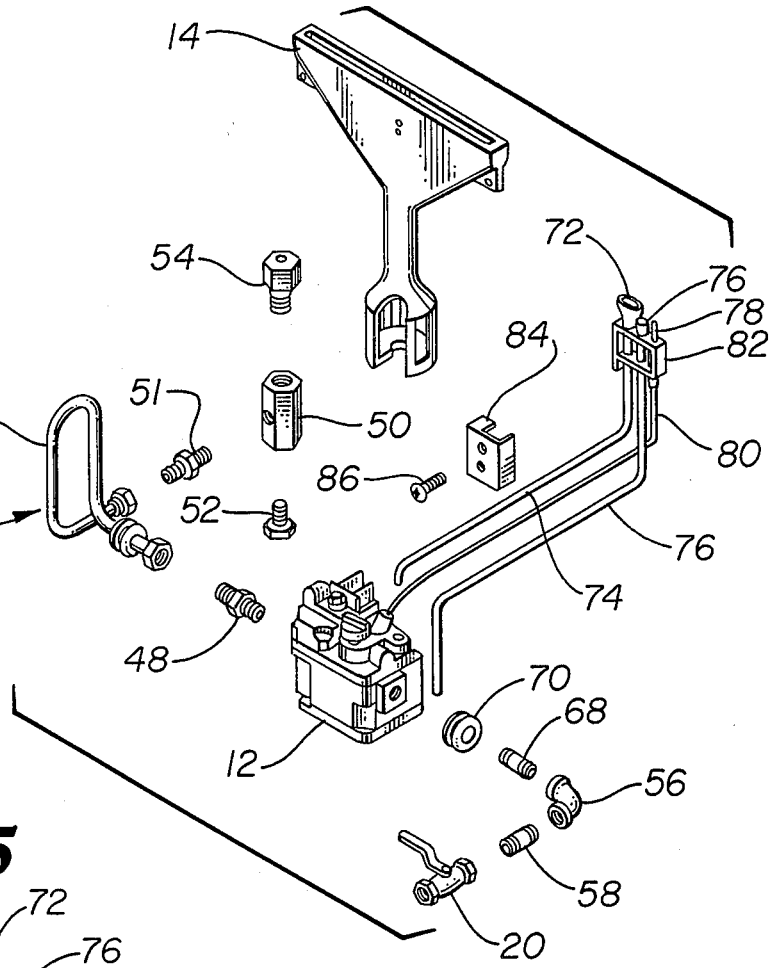
FIG. 3 is an exploded perspective view of the gas control valve including gas and vent lines.
Figure 4:
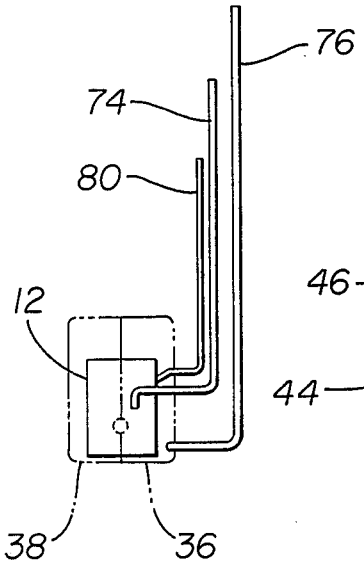
FIG. 4 is a side view of the gas control valve.
Figure 5:
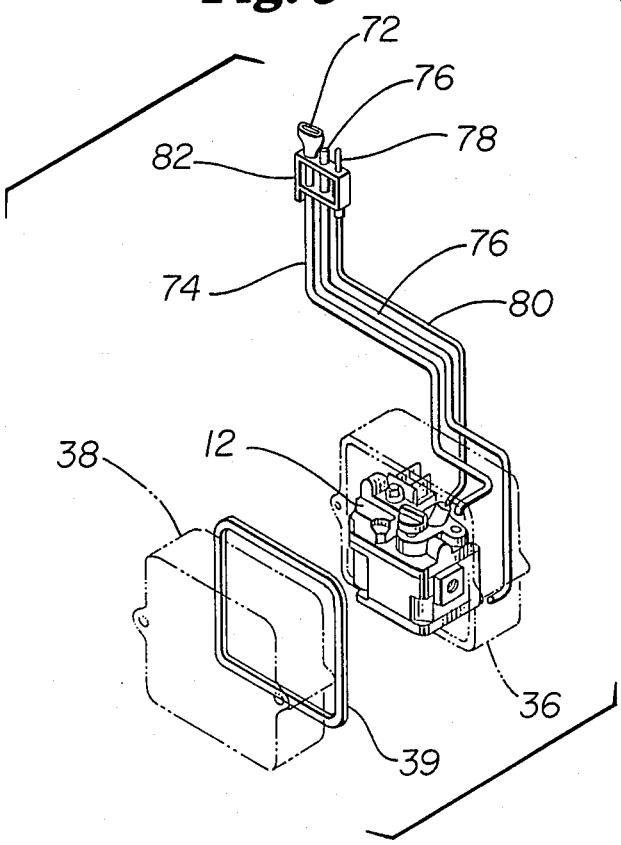
FIG. 5 is a perspective view of the gas control valve with covers opened.

Referring to the drawings, a furnace 10 with an enclosed gas control valve 12 in accordance with the present invention is depicted in FIGS. 1 and 2. The furnace 10 is covered by a furnace cover 13 and includes a burner 14. The burner 14 is mounted below a heating chamber 16. The burner 14 is connected to the gas control valve 12. The gas control valve 12 is connected to a main gas line (not shown) through a main gas line valve 20. The gas control valve 12 is connected to a electrical control mechanism 22. A high temperature limit switch 24 is mounted on the heating chamber 16 and is electrically connected to the electrical control mechanism 22 by limit switch wires 25. A suitable high temperature limit switch is Model No. V3L-163-D8 available from Thermo-disk Incorporated, Mansfield, Ohio 44907.

A blower 26 is coupled to the heating chamber 16 and an air outlet 28 and is electrically connected to the electrical control mechanism 22 by blower wires 27. An air flow sail switch 30 is mounted on the air outlet 28 and is electrically connected to the electrical control mechanism 22 by sail switch wires 31. A suitable switch is available from Honeywell, Incorporated Microswitch Division, with an air paddle added.

A thermostat control 32 is electrically connected to the electrical control mechanism 22 by the power cord 34. A suitable control is available from Long Lasting Farm Equipment, Garnavillo, Iowa 52049.

The gas control valve 12 is mounted in a gas control valve enclosure base 36 and a gas control valve enclosure cover 38. The gas control valve enclosure base 36 and gas control valve cover 38 are sealed with a gasket 39. The electrical control mechanism 22 is mounted in a electrical control mechanism enclosure base 40 and a electrical control mechanism enclosure cover 42. The electrical control mechanism base 40 and electrical control mechanism cover 42 are sealed with a gasket 43.

An example of a suitable gas control valve 12 is Model No. 7000 BER-LP (for liquid propane use) or Model No. 7000 BER-NG (for natural gas use) available from Robert Shaw Controls Company, Corona, Calif. 91719.

The gas control valve 12 connects to the burner 14 through the burner gas conduit 44. The burner gas conduit 44 comprises a burner gas line 46 connected to the gas control valve 12 and a burner gas line adapter 50 by connectors 48 and 51. The burner gas line adapter 50 is mounted in the burner 14 by the burner gas line adapter mounting bolt 52. A burner gas valve 54 mounts at the base of the burner 14 on the burner gas line adapter 50.

The main gas line valve 20 connects to the furnace on one end through an elbow joint 56 by connector 58 and to a gas regulator line 60 through connector 62. The gas regulator line 60 connects to the gas regulator 64 through connector 66. The gas regulator 64 connects to the main gas line (not shown). The elbow joint 56 connects to the gas control valve 12 through connector 68 and sleeve 70.

A pilot light 72 connects to the gas control valve 12 through a pilot light gas line 74. A vent line 76 runs from the pilot light 72 to the base of the gas control valve enclosure base 36. A thermocouple 78 is positioned near the pilot light 72 and is connected to the gas control valve 12 by a thermocouple line 80. The pilot light 72, vent line 76 and thermocouple 78 are held in place by the bracket 82 and mounted to the burner 14 by the bracket cover 84 and the bracket mounting screw 86.

In operation, the gas control valve 12 receives gas at regulated pressure from the gas regulator line 60 and conducts it to the pilot light 72 and the burner 14 respectively. The thermostat control 32 activates gas control valve 12 to conduct gas to the burner 14 when the ambient temperature falls below a predetermined level, and turns off the valve connection to burner 14 when the ambient temperature exceeds a predetermined level. Gas coming out of the burner 14 is ignited by the pilot light 72. The blower 26 forces air through the heating chamber 16 where the air is heated by the burning gas from the burner 14.

The high temperature limit switch 24 shuts off the gas to the burner 14 when the heating chamber 16 temperature exceeds a predetermined level. The airflow sail switch 30 shuts off the gas to the burner 14 when the air pressure from the blower 26 falls below a predetermined level. The thermocouple 78 shuts off gas to the pilot light 72 and the burner 14 when the temperature near the pilot light 72 drops below a predetermined level indicating the pilot light 72 flame has been extinguished.

The gas control valve enclosure base 36, gas control valve enclosure cover 38 and gasket 39 form a watertight seal around the gas control valve 12 thereby preventing exposure of the gas control valve 12 to the environment. If the gas control valve 12 leaks gas, the vent line 76 vents the leaked gas to the pilot light 72 where it undergoes controlled combustion thereby preventing the formation of a explosive mixture of gas and air. The main gas line valve 20 shuts off the gas supply to the entire furnace 10. The electrical control mechanism enclosure base 40, electrical control mechanism enclosure cover 42 and gasket 43 form a watertight seal around the electrical control mechanism 22 thereby sealing the electrical control mechanism from the environment.

Having thus described the invention the following is claimed:

1. In a gas burning furnace having a main burner, a pilot light, a gas control valve for controlling flow of gas to the main burner and pilot light, respectively, the improvement comprising:

a. a water-tight enclosure surrounding the gas control valve, thereby isolating it from the environment and the main burner and pilot light, and b. a vent line extending from the interior of the enclosure to the pilot light for venting and burning any gas which might leak into the enclosure.

2. The gas burning furnace of claim 1 and a high temperature limit switch for stopping gas flow to the main burner if the furnace temperature exceeds a predetermined level.

3. The gas burning furnace of claim 2 and a blower coupled to the heating chamber for passing a stream of air over the main burner and an air flow sail switch disposed downstream from the blower for stopping gas flow to the main burner if the airstream flow rate drops below a predetermined level.

4. The gas burning furnace of claim 3 and a thermocouple for stopping gas flow to the main burner and pilot light if the pilot light flame is extinguished.

5. The gas burning furnace of claim 1 and a blower coupled to the heating chamber for passing a stream of air over the main burner and an air flow sail switch disposed downstream from the blower for stopping gas flow to the main burner if the airstream flow rate drops below a predetermined level.

6. The gas burning furnace of claim 1 and a thermocouple for stopping gas flow to the main burner and pilot light if the pilot light flame is extinguished.

* * * * *